US005785572A

United States Patent [19]

Levy et al.

[11] Patent Number: 5,785,572

[45] Date of Patent: Jul. 28, 1998

[54] TRANSFORMABLE POWER WRENCH AND ENGINE FOR TOY VEHICLE

[76] Inventors: Richard C. Levy, P.O. Box 34828, Bethesda, Md. 20827; Richard J. Maddocks, 302 Lexington Dr., Silver Spring, Md. 20901; Dudley J. Reynolds, 9 Calshot Way, Enfield, Middlesex EN27BQ, England

[21] Appl. No.: 599,174

[22] Filed: Feb. 9, 1996

[51] Int. Cl.[6] ..... A63H 33/30; A63H 27/00; A63H 29/02; A63H 17/28

[52] U.S. Cl. ..... 446/144; 446/88; 446/439; 446/462

[58] Field of Search ..... 446/85, 86, 87, 446/88, 93, 97, 144, 145, 439, 457, 462, 470, 471; 81/177.1, 177.6

[56] References Cited

U.S. PATENT DOCUMENTS

| | | | |
|---|---|---|---|
| 2,627,698 | 2/1953 | Wood . | |
| 2,829,285 | 4/1958 | Steiner et al. . | |
| 3,528,193 | 9/1970 | Yamakawa . | |
| 3,553,885 | 1/1971 | Tazaki . | |
| 3,608,233 | 9/1971 | Aoki . | |
| 3,811,218 | 5/1974 | Salmon et al. . | |
| 3,859,749 | 1/1975 | Morin et al. . | |
| 3,924,352 | 12/1975 | Goldfarb et al. . | |
| 3,961,440 | 6/1976 | Saito . | |
| 4,183,173 | 1/1980 | Ogawa . | |
| 4,189,864 | 2/1980 | Saito | 446/462 X |
| 4,209,941 | 7/1980 | Borque | 446/439 X |
| 4,522,270 | 6/1985 | Kishi | 81/177.1 X |
| 4,542,667 | 9/1985 | Jang | 81/177.6 X |
| 4,575,352 | 3/1986 | Matsuda . | |
| 4,744,272 | 5/1988 | Leatherman | 81/177.6 X |
| 4,889,516 | 12/1989 | Auer et al. . | |
| 5,078,641 | 1/1992 | Chen . | |
| 5,209,692 | 5/1993 | Coleman et al. . | |

FOREIGN PATENT DOCUMENTS

| | | | |
|---|---|---|---|
| 257869 | 3/1928 | Italy | 81/177.6 |
| 297210 | 9/1928 | United Kingdom | 81/177.6 |

*Primary Examiner*—D. Neal Muir
*Attorney, Agent, or Firm*—Nixon & Vanderhye

[57] ABSTRACT

A power tool is transformable from a power wrench configuration for use in fastening elements forming a toy vehicle to an engine for the toy vehicle. The power wrench includes a handle having sections pivotally mounted to the housing of the wrench. The handle sections, when used as a wrench, form a single handle for the wrench and are pivoted away from one another to lie along opposite sides of the housing. The handle sections have portions simulative of an actual engine whereby the power wrench may be transformed to a toy engine simulative of an actual full-scale engine. The engine may be disposed in the toy built with the power wrench.

16 Claims, 6 Drawing Sheets

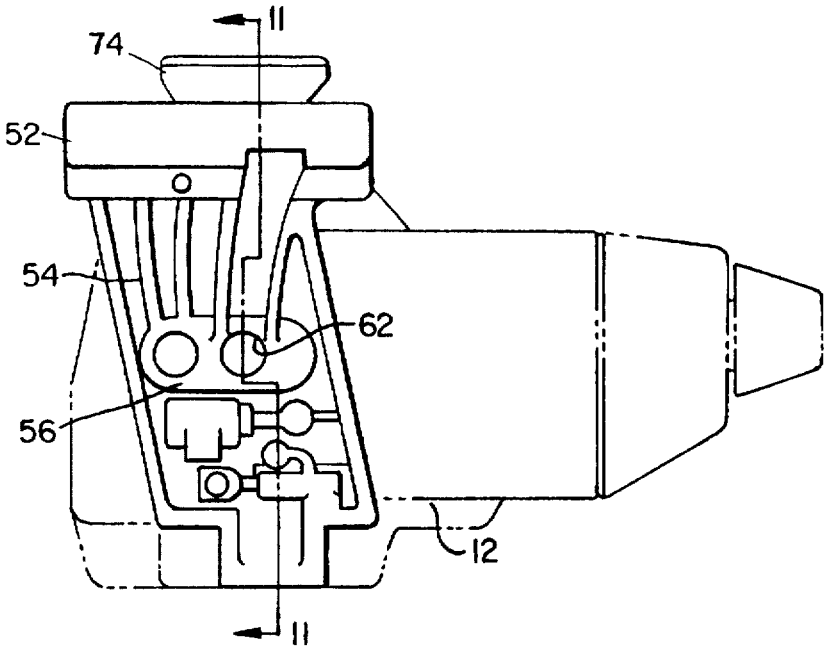
Fig.10
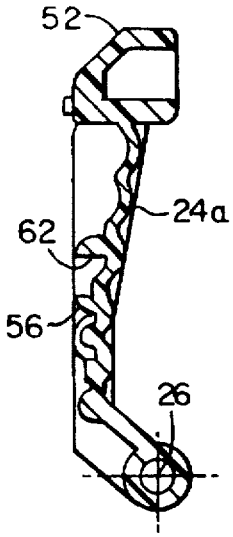
Fig.11
Fig.12
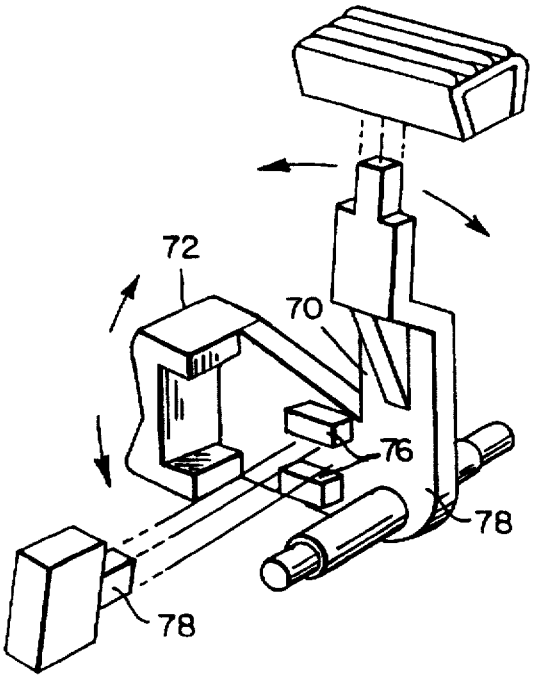

TRANSFORMABLE POWER WRENCH AND ENGINE FOR TOY VEHICLE

TECHNICAL FIELD

The present invention relates to toy vehicles in general and, in particular, to a power wrench which can be transformed to an engine for a toy assembled using the power wrench, the engine being simulative of a full-scale vehicle engine.

BACKGROUND

In recent years, toys which are transformable to another shape have been in particular demand. For example, action toy figures such as robots have the capability of being transformed into another type of toy, for example, a vehicle. Another example is a toy gun convertible into a robot humanoid form, as set forth in U.S. Pat. No. 4,575,352. In a variation of these transformable toys, there has been previously provided a combination toy vehicle and screwdriver, for example, as set forth in U.S. Pat. No. 5,078,641. In that patent, there is disclosed an electrically operated screwdriver having a main control housing in the form of the contour of a person, the housing having a handle. The electrically operated screwdriver is employed to assemble the various parts of the toy. For example, as illustrated in that patent, the electric-powered screwdriver is employed to secure the various parts of the airplane to one another and thereafter is received in the airplane to drive wheels such that the airplane is propelled along a surface. The handle and the figure of the person on the screwdriver remain in that form when received in the airplane.

DISCLOSURE OF THE INVENTION

According to the present invention, there is provided a power wrench for use in assembling the parts of a vehicle and which wrench is transformable by manipulation of the handle of the wrench to form, with the body of the wrench, an engine for driving the toy vehicle. The engine, upon transformation, simulates a full-scale engine with various features common to such full-scale engine, such as intake valve covers, a crankcase, exhaust manifold and the like. By full-scale engine is meant an engine typically found in modern-day automobiles or race cars. To accomplish this, the power wrench is provided with a body which includes a housing for a drive motor, for example, a three-volt DC motor, a battery compartment for providing current to the motor, and reduction gearing coupling the motor drive to a rotatable tool holder. The tool holder preferably has a socket for receiving a tool. The body also includes a handle which projects to one side of the housing. A switch is located at the back of the housing such that an individual can grip the handle, actuate the switch and employ the wrench as a power tool to drive fasteners to assemble a toy vehicle.

The various parts for the vehicle are secured one to the other by fasteners having heads complementary in shape to the shape of the tool received in the tool holder of the power wrench. For example, standard slotted fastener heads may be used where the power wrench has a screwdriver-type tool. Upon completion of the vehicle assembly, which also includes the formation of an engine compartment in the toy vehicle, the power wrench may be transformed into an engine for driving the toy vehicle, while at the same time, the transformation effects a change of appearance from that of a power wrench to a toy engine simulative of a realistic actual full-scale automobile or race car engine. To accomplish this, the handle of the power wrench is pivotal from its projecting position to a position along at least one side of the housing of the power wrench. Various indicia on the handle, when displaced to form the toy engine simulating the real full-scale engine, are representative of various parts of the full-scale engine. For example, intake covers, crankcase covers, an alternator, an exhaust manifold and the like, may be simulated along the sides of the handle which, when juxtaposed with the wrench housing and other indicia already on the wrench housing, form a toy engine simulative of a realistic engine such as a turbo V-8 engine. It will be appreciated that other types of engines may be simulated, for example, a gas turbine, a jet engine and various types of internal combustion automobile engines, such as four or six-cylinder engines.

Preferably, the handle is split into sections along a midline in a plane also containing the axis of rotation of the tool holder. The sections are pivotable from a handle-forming position about discrete axes parallel to the axis of rotation of the tool holder substantially 180° to lie along opposite sides of the wrench housing into an engine-simulating position. In the handle-forming position, a switch is located along the back of the housing for ready access when the tool is used as a power wrench. The facing surfaces of the sections when forming the wrench handle register one with the other and have indicia of a simulated full-scale automobile engine. Thus, when the handle sections are pivoted away from one another and along the opposite sides of the wrench housing, the indicia forms the outer sides of the toy engine simulating the full-scale engine. With the handles lying along opposite sides of the wrench housing, the toy engine may be disposed in the engine compartment of the vehicle, with the tool holder coupled to a transmission in the toy vehicle whereby the toy engine drives the toy vehicle. A second switch may be disposed on top of the housing in a position accessible externally of the vehicle so that the individual may activate and deactivate the motor for the toy vehicle.

In a preferred embodiment according to the present invention, there is provided a power tool transformable to an engine for a toy, the engine being simulative of a full-scale vehicle engine, comprising a body including a housing, a motor within the housing, a tool holder for holding a tool and rotatably carried by the housing and a drive between the motor and the tool holder for rotating the tool holder, a handle carried by the body including a section pivotal between a first position projecting from the body and forming a handle grip for the housing thereby forming a hand-held power tool and a second position extending along at least one side of the housing and having portions of the section simulative of at least a portion of an engine whereby the body forms an engine for a toy.

In a further preferred embodiment according to the present invention, there is provided a power tool transformable to an engine for a toy, the engine being simulative of a full-scale vehicle engine, comprising a body including a housing, a motor within the housing, a tool holder for holding a tool and rotatably carried by the housing and a drive between the motor and the tool holder for rotating the tool holder, a handle carried by the body including a pair of handle sections movable between a first position projecting from the body and forming a handle grip for the housing thereby forming a hand-held power tool, and a second position extending along opposite sides of the housing with each section having portions thereof simulative of at least a portion of a full-scale engine whereby the body forms an engine for a toy.

Accordingly, it is a primary object of the present invention to provide a novel and improved power wrench transformable into an engine for a toy vehicle wherein the engine is simulative of a full-scale engine, such as a turbo V-8 automobile engine, and wherein the handle for the power wrench is specifically configured to form part of the simulated full-scale engine when the toy engine is disposed in the vehicle.

BRIEF DESCRIPTION OF THE DRAWINGS

FIG. 10 is a side elevational view of the handle section folded into the engine and illustrating details of the simulated full-scale engine;

FIG. 11 is a cross-sectional view thereof taken generally about on lines 11—11 in FIG. 10; and FIG. 12 is a perspective view of a portion of the switch assembly within the power wrench body.

BEST MODE FOR CARRYING OUT THE INVENTION

Figure 1:
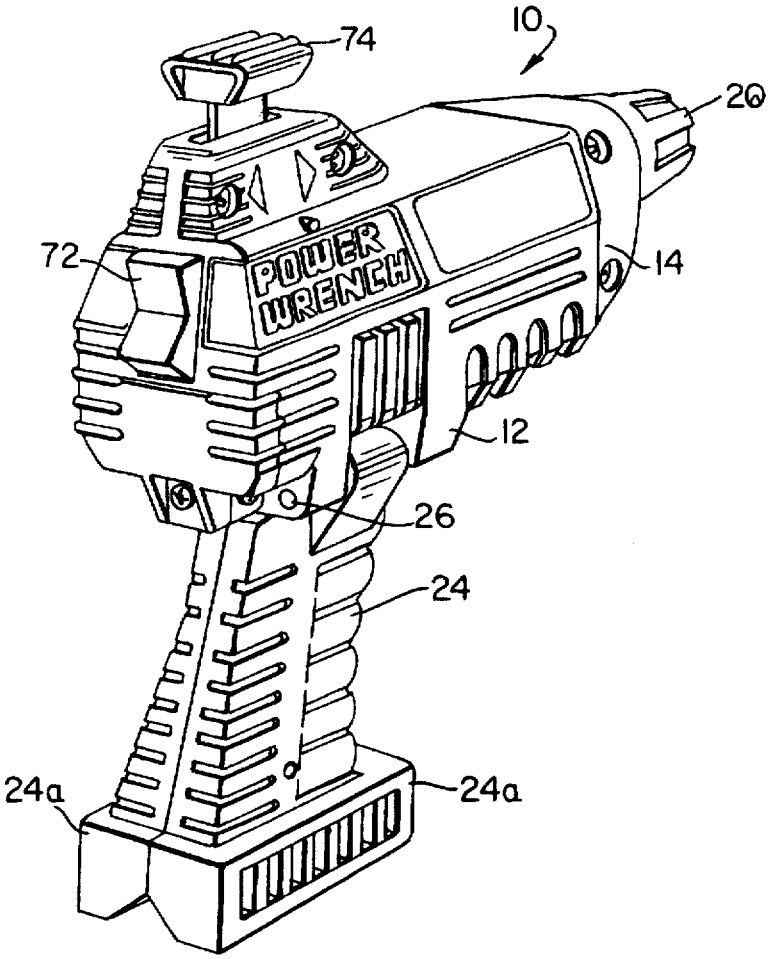
FIG. 1 is a perspective view of a power wrench according to the present invention.
Figure 2:
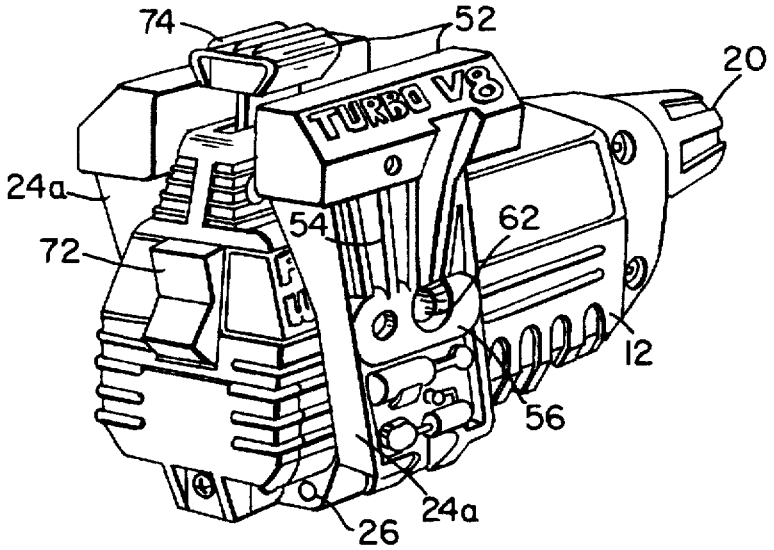
FIG. 2 is a similar perspective view illustrating the power wrench transformed into an engine for a toy vehicle simulative of a full-scale engine.
Figures 5, 6:
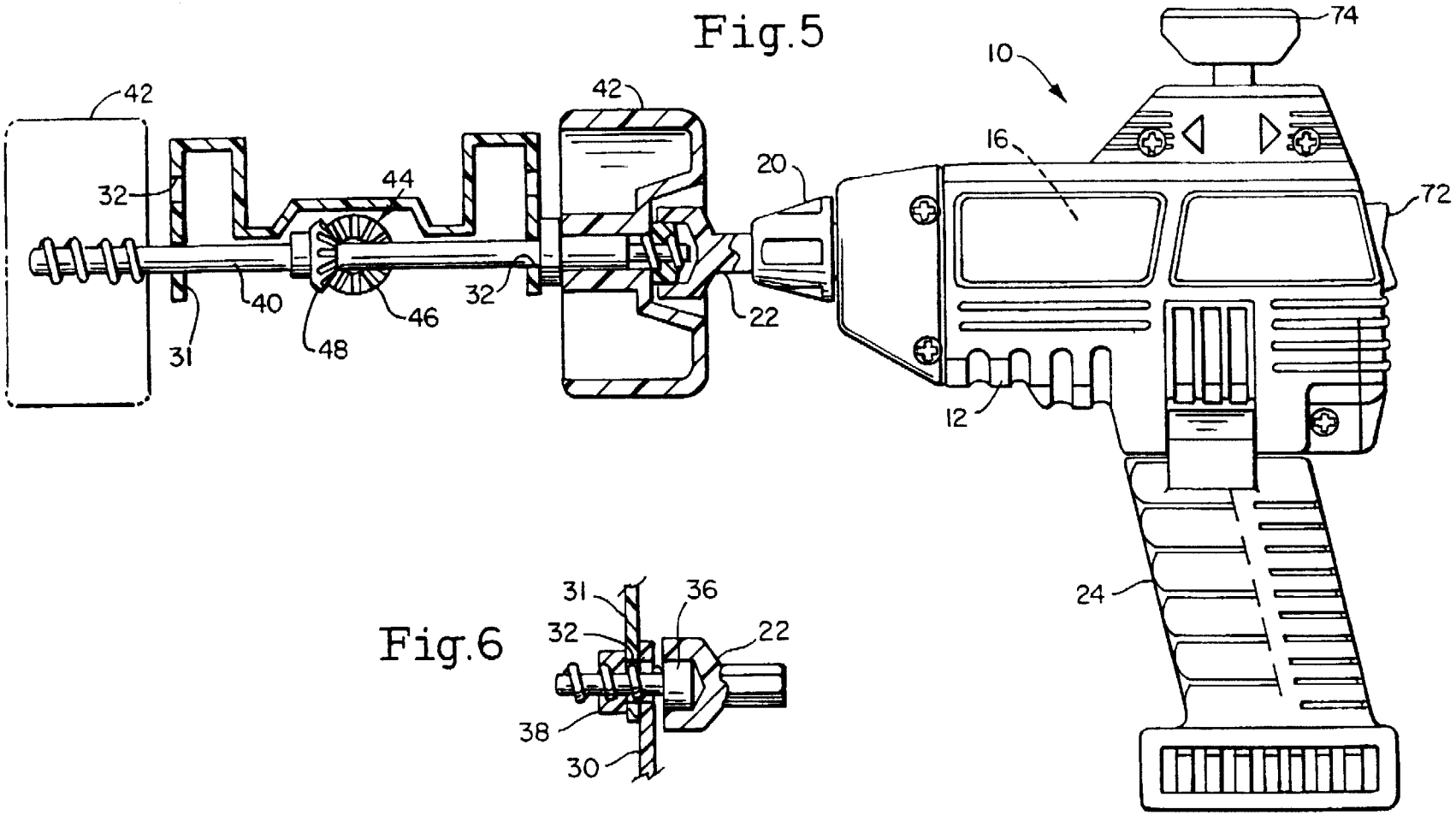
FIG. 5 is a side elevational view with portions in cross-section of the power wrench applied to the toy vehicle during its assembly.
FIG. 6 is an enlarged cross-sectional view illustrating the tool applied to fastening elements of the vehicle.
Figure 5A:
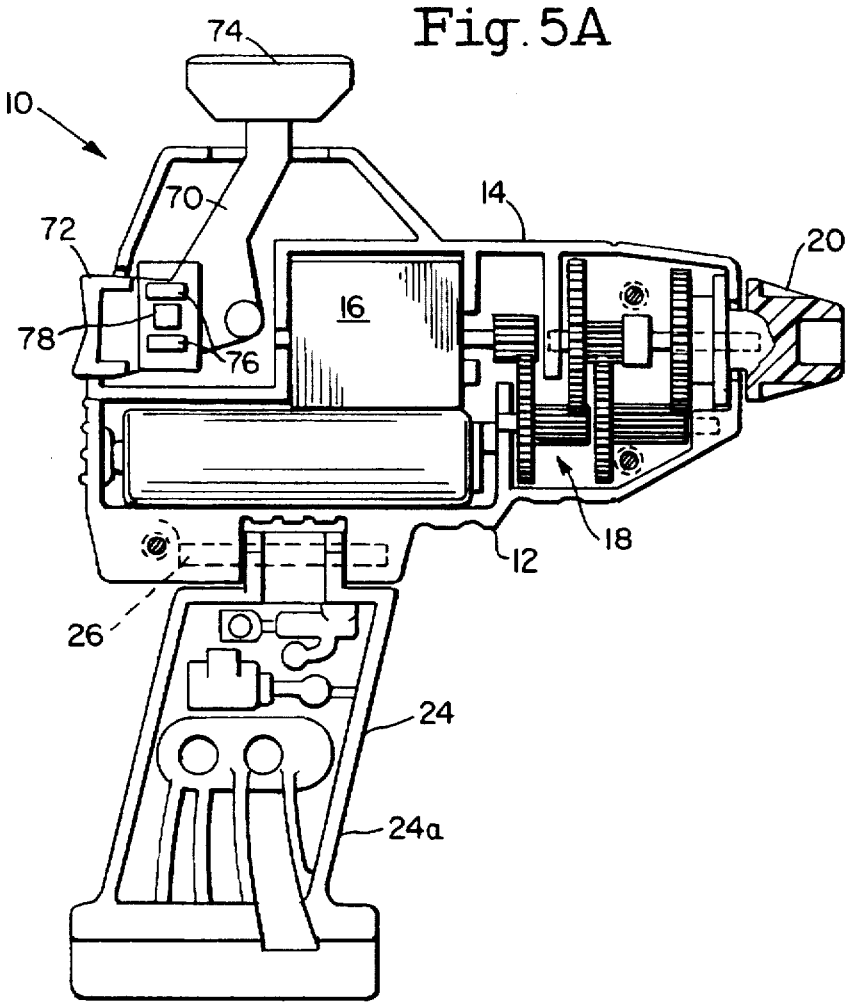
FIG. 5A is a vertical section through the power wrench.

Referring now to the drawings, particularly to FIGS. 1 and 2, there is illustrated a power wrench, generally designated 10, constructed in accordance with the present invention. With reference to FIG. 5A, wrench 10 has a body 12 including a housing 14, a motor 16 within the housing, a gear reduction 18, a tool holder 20 for holding a tool 22. It will be appreciated that the drive for the tool holder including the motor, reduction gearing and the power supply, for example, batteries are of conventional construction and further description thereof is not believed necessary. The power tool 10 also includes a handle 24 comprised of handle sections **24*a* pivoted about discrete axes 26 which lie generally parallel to the axis of rotation of the tool holder 20. Upon comparing FIGS. 1 and 2, it will be appreciated that the handle sections 24*a* are pivotable about axes 26 from a first position as illustrated in FIG. 1 where sections 24*a* form handle 24 for the power wrench 10 and a second position substantially 180° therefrom where the sections 24*a* lie on opposite sides of housing 14** in a manner simulative of an actual or full-scale vehicle engine. While the handle sections are preferably pivotal between the first and second positions, it will be appreciated that other mechanical motions may be used to displace the handle sections between those positions. For example, a combination of linear and pivotal motions or a complete removal of the handle sections and reattachment thereof may be effected to achieve those positions.

Figure 3:
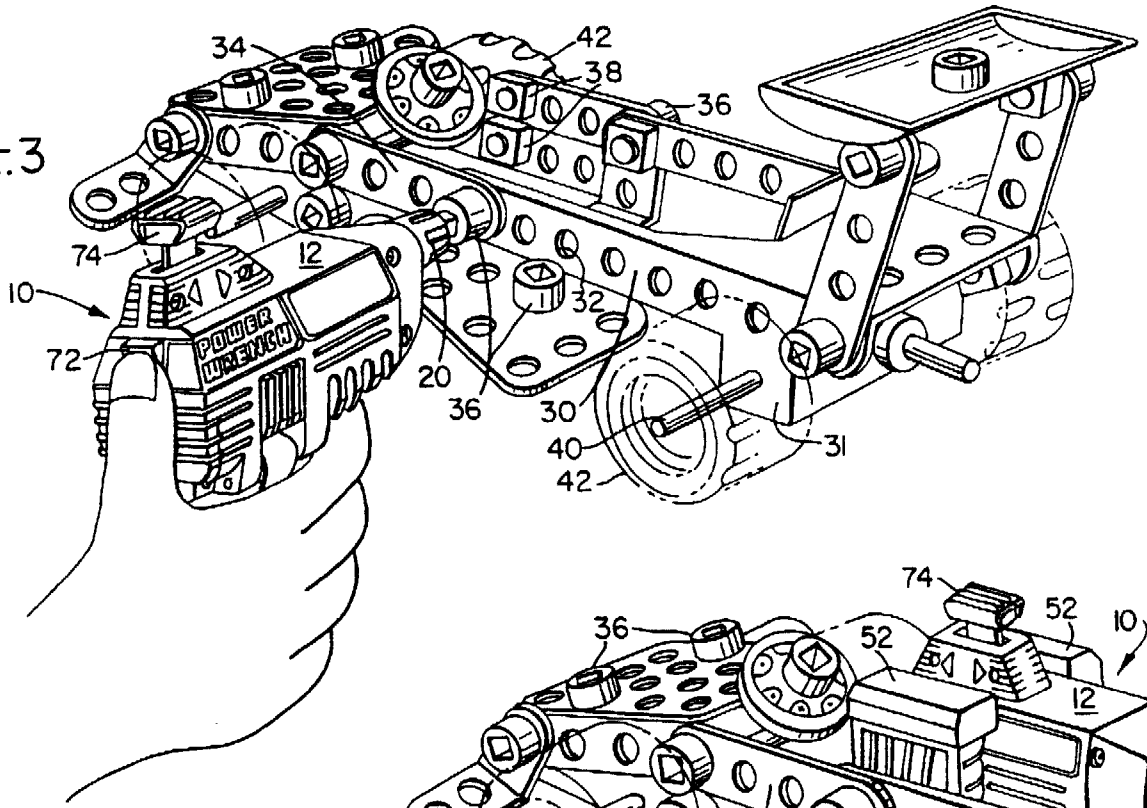
FIG. 3 is a schematic perspective view illustrating use of the power wrench in the construction of the toy vehicle.
Figure 4:
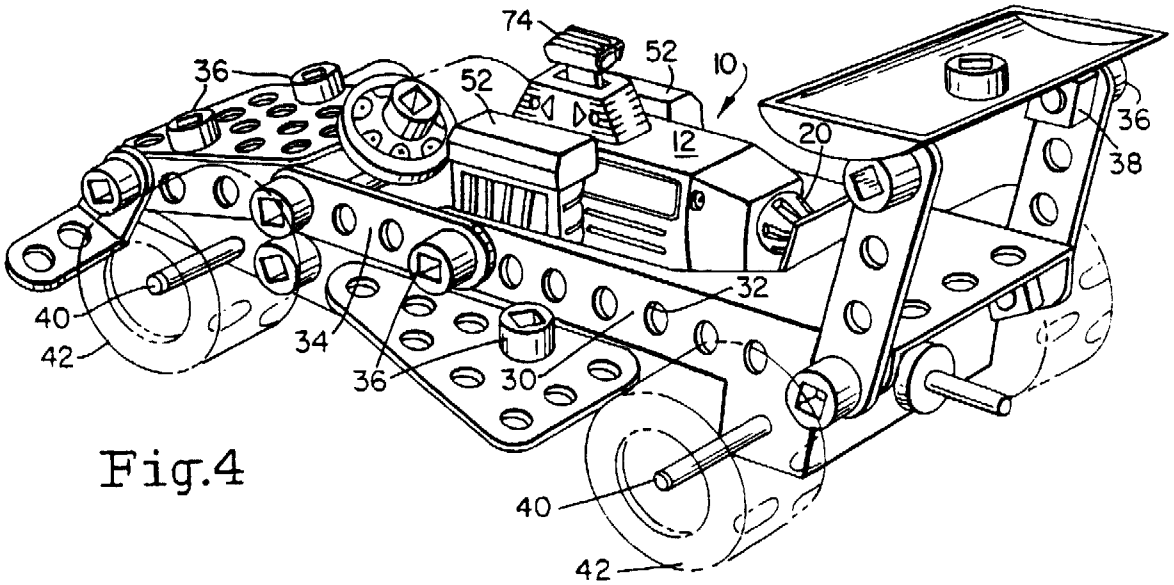
FIG. 4 is a perspective view similar to FIG. 3 illustrating the transformed power wrench into its engine form and disposed in the toy vehicle.
Figure 7:
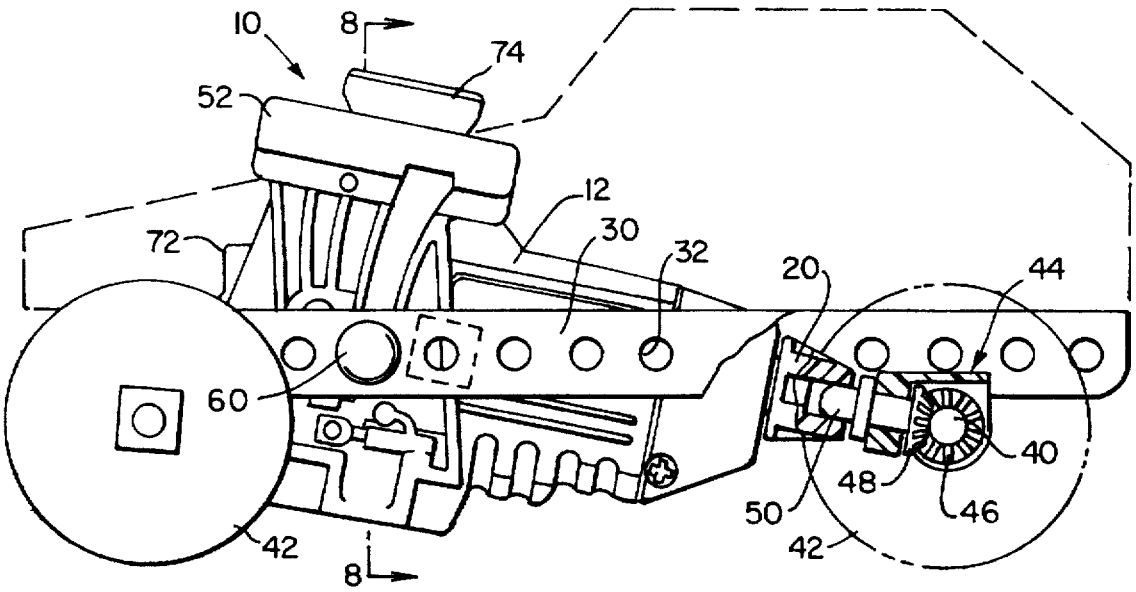
FIG. 7 is a schematic side elevational view of the toy vehicle with parts thereof broken out and with the toy engine mounted in the vehicle.
Figure 9:
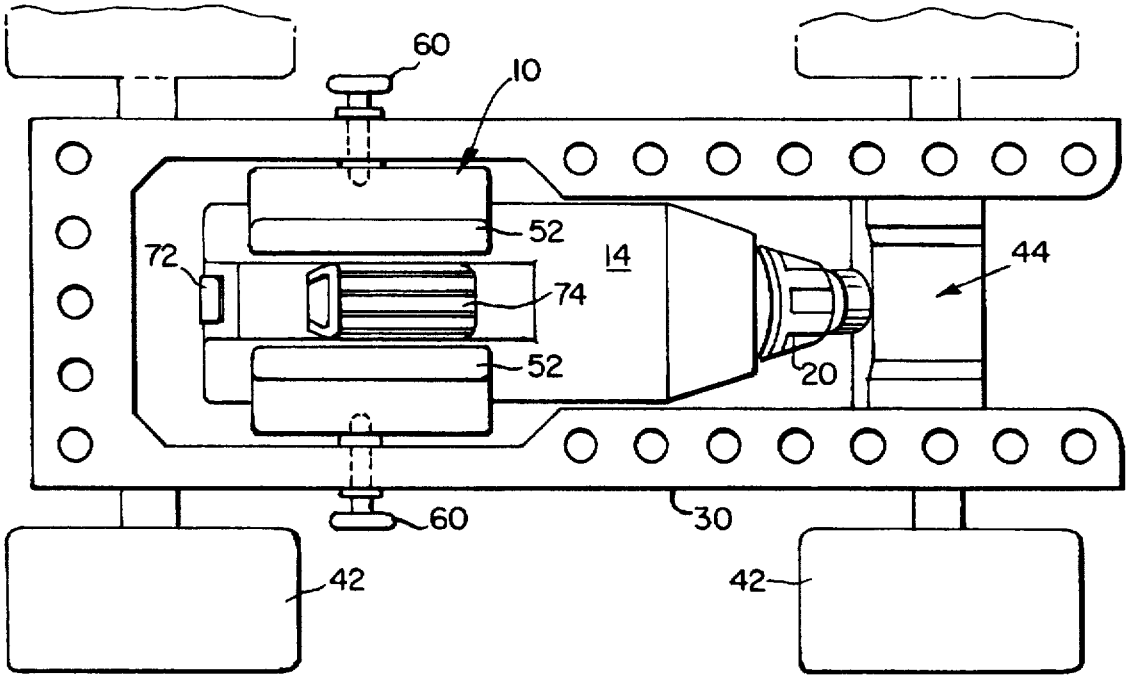
FIG. 9 is a partial top plan view of the vehicle of FIG. 7.

Referring to FIGS. 3 and 4, the toy vehicle may comprise any one of a substantial number of different types of constructions. Suffice to say that the toy vehicle may be formed of a plurality of individual elements secured together by fasteners of a type cooperable with the tool 22 of the power wrench whereby the toy vehicle can be assembled and disassembled using the power wrench. For example, the chassis of the vehicle may comprise a plurality of longitudinally extending members, preferably formed of plastic which have a plurality of apertures 32 in the members. As illustrated in FIG. 3, the elongated member 30 is being secured to a further structural member 34 by means of a nut-and-bolt arrangement, the bolt 36 having an enlarged head and a rectilinear socket 38, for example, a hex socket, for cooperation with a complementary hex-shaped tool, not shown, held by the tool holder 20. The bolt has screw threads and may be secured by the nut 38. It will be appreciated that other types of fastening elements may be employed, such as screws having slotted heads or Phillips heads and that an appropriate tool may be used with the power wrench to fasten the elements to one another to form the vehicle. It will be appreciated that the elements forming the vehicle can be variously arranged and be of various configurations so that the appearance of the vehicle can be changed for a given number of structural elements. In the illustrated form, a toy vehicle of a race car type is shown. Thus, the main chassis has depending elements 31 on which the axles 40 for the wheels 42 may be rotatably mounted. Referring to FIGS. 5 and 7, the vehicle may have a transmission 44 comprised of a pair of right angularly related pinion gears 46 and 48, the gear 48 being mounted on the axle 40 of the rear wheels for the vehicle. Thus, axle 40 may extend through the elements 31 forming part of the vehicle body and the power wrench used to screw-thread a nut on one end of the axle to secure the wheels and axle to the vehicle. As illustrated in FIG. 7, the opposite end of the pinion 46 has a projecting shaped coupling 50 which is receivable in a correspondingly-shaped opening of the tool holder 20 such that when the power wrench is transformed to a toy engine, the engine may be disposed between the vehicle in a manner to drive the vehicle.

Figure 8:
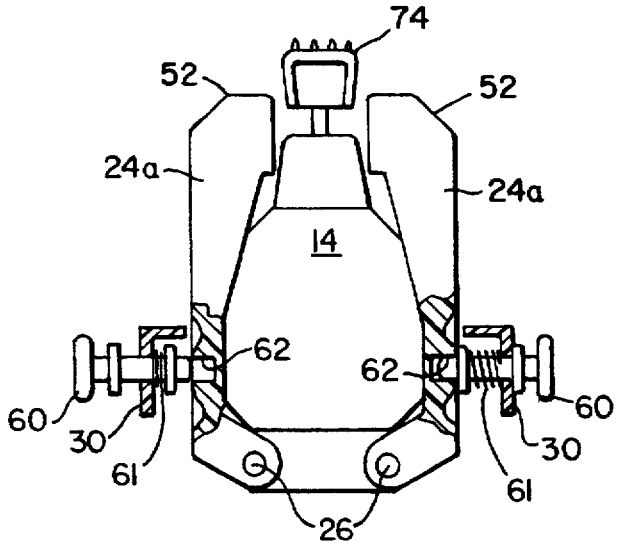
FIG. 8 is a cross-sectional view thereof taken generally about on lines 8—8 in FIG. 7.

Consequently, when the vehicle has been assembled and it is desired to transform the power wrench to the toy engine, the sections **24*a* of handle 24 are pivoted about axes 26 to lie along opposite sides of the wrench housing 14 as illustrated in FIG. 8. Referring to FIGS. 2, 10 and 11, the sections 24*a* are configured, along their registering faces when in the power wrench handle position and along their outer faces when in the toy engine configuration, to simulate various elements of an actual full-scale engine. For example, the outer faces of sections 24*a* as illustrated in FIGS. 2 and 10 may be formed to simulate valve covers 52, exhaust pipes 54, an exhaust manifold 56, and various other elements of an actual engine. These elements register one with the other when the sections are folded into the handle 24 as illustrated in FIG. 1 but when exposed upon pivoting into the simulated actual engine, provide, in conjunction with the housing 14, the appearance of an actual full-scale engine. After pivoting the sections 24*a* into the engine-simulating position, the simulated engine may be disposed within the engine compartment of the toy. For example, the elements forming the chassis of the toy vehicle may have spring-biased coupling members 60 (FIG. 8) along opposite sides of the elements 30. The springs 61 bias the element 60 inwardly such that, upon displacing the element 60 outwardly against the bias of the springs, the simulated engine can be disposed within the engine compartment between elements 60. Cooperative recesses 62 may be formed along the surface of the handle sections 24a to receive the inner ends of the element 60 whereby the engine can be secured in the engine compartment. When disposing the engine in the engine compartment, the tool holder 20 may be aligned with the forward tip of the pinion 46 to effect a coupling between the motor within the housing and the transmission for driving the rear wheels. Thus, the toy engine is supported by the elements 60 and the transmission pinion 46. It will be appreciated that the handle sections 24a may have cooperating catches to maintain the handle sections in the handle configuration, e.g., FIG. 1, and similar catches along outer surfaces thereof which cooperate with the body 12 when the sections 24a are pivoted into the engine simulative position of FIG. 2** to maintain the handle sections in one of their two orientations.

Referring now to FIG. 12, the housing also includes a switch member 70 so that the motor can be actuated from two different positions. The switch member 70 is pivotally mounted within the housing and has a first thumb switch 72 and a second switch 74 which are substantially right angularly related whereby the second switch 74 projects from an upper portion of the housing, while the thumb switch 72 projects from a rear portion of the housing. Thus, as illustrated in FIG. 3, the power wrench can be grasped by the handle 24 and the individual's thumb may operate the switch 72 to activate and deactivate the wrench. When the power wrench has been transformed to a toy engine, the toy engine can be operated by pivoting the switch 74 from the top of the engine. The switch 74 may be configured to simulate part of an engine, for example, an air scoop. The body of the switch 70 carries a pair of projections 76 between which is mounted a toggle switch element 78. The toggle switch 78 is coupled in the circuit between the power supply and the motor whereby pivoting action of the body 70 pivots the toggle switch 78 between motor on and off positions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A power tool transformable to an engine for a toy, the engine being simulative of a full-scale vehicle engine, comprising:

a body including a housing, a motor within said housing, a tool holder for holding a tool and carried by said housing for rotation about an axis and a drive between said motor and said tool holder for rotating said tool holder;

a handle carried by said body including a first section pivotal between a first position projecting from said body and forming a handle grip for said housing thereby forming a hand-held power tool and a second position extending along at least one side of said housing and having portions of said section simulative of at least a portion of an engine whereby the body forms an engine for a toy, said section being pivotal between said first and second positions about a discrete axis generally parallel to the rotatable axis of said tool holder.

2. A tool according to claim 1 wherein said handle includes a second section pivotal between a first position projecting from said body and forming with said first section said handle grip for said housing and a second position extending along a second side of said housing opposite said first side and having portions simulative of at least a portion of said engine, said second section being pivotal between said first and second positions thereof about a discrete axis generally parallel to the rotatable axis of said tool holder.

3. A tool according to claim 2 wherein said pivotal axes of said first and second sections are non-coincident with one another.

4. A tool according to claim 2 wherein said pivotal axes of said first and second sections are non-coincident with said axis of rotation of said tool holder.

5. A tool according to claim 2 wherein said pivotal axes of said first and second sections are non-coincident with one another and the axis of rotation of said tool holder.

6. A tool according to claim 2 wherein the portions of said first and second sections simulative of at least a portion of said engine lie in registration with one another when said first and second sections lie in said first positions thereof.

7. A tool according to claim 1 in combination with a toy vehicle constructed of a plurality of parts joined to one another by fasteners, a tool carried by said tool holder, said fasteners and said tool having complementary surfaces whereby, upon engagement of said tool and said fasteners with said sections in said first position, said power tool is operable to fasten said parts to one another, said toy vehicle including wheels, a drive for said wheels, and a compartment for receiving said body with said sections in said second position thereof and said motor coupled to said wheel drive for driving the toy vehicle, a switch carried by said body for actuating said motor, first and second switch actuators carried by said body for actuating said switch, said first switch actuator being accessible by a user from said handle grip when said sections lie in said first position and said tool is used to fasten said parts to one another, said second switch actuator being accessible by a user when the sections lie in said second position and said toy engine simulative of a full-scale engine is disposed in said compartment.

8. A tool according to claim 1 including a second handle section lying side-by-side with said first section in said first position thereof, said portions of said first section simulative of at least a portion of an engine lying in registration with a face of said second section when said first section lies in said first position.

9. A power tool transformable to an engine for a toy, the engine being simulative of a full-scale vehicle engine, comprising:

a body including a housing, a motor within said housing, a tool holder for holding a tool and rotatably carried by said housing and a drive between said motor and said tool holder for rotating said tool holder;

a handle carried by said body including a pair of handle sections movable between a first position projecting from said body and forming a handle grip for said housing thereby forming a hand-held power tool, and a second position extending along opposite sides of said housing with each section having portions thereof simulative of at least a portion of a full-scale engine whereby the body forms an engine for a toy, said tool holder being rotatable about an axis, said handle being split along a midline thereof to form said sections, said midline lying in a plane containing said axis.

10. A tool according to claim 9 including a switch carried by said body for actuating said motor.

11. A tool according to claim 9 in combination with a toy vehicle constructed of a plurality of parts joined to one another by fasteners, a tool carried by said tool holder, said fasteners and said tool having complementary surfaces whereby, upon engagement of said tool and said fasteners with said sections in said first position, said power tool is operable to fasten said parts to one another, said toy vehicle including wheels, a drive for said wheels, and a compartment for receiving said body with said sections in said second position thereof and said motor coupled to said wheel drive for driving the toy vehicle.

12. A tool according to claim 11 including a switch carried by said body for actuating said motor, first and second switch actuators carried by said body for actuating said switch, said first switch actuator being accessible by a user from said handle grip when said sections lie in said first position and said tool is used to fasten said parts to one another, said second switch actuator being accessible by a user when the sections lie in said second position and said toy engine simulative of a full-scale engine is disposed in said compartment.

13. A power tool transformable to an engine for a toy, the engine being simulative of a full-scale vehicle engine, comprising:

a body including a housing, a motor within said housing, a tool holder for holding a tool and rotatably carried by said housing and a drive between said motor and said tool holder for rotating said tool holder;

a handle carried by said body including a pair of handle sections movable between a first position projecting from said body and forming a handle grip for said housing thereby forming a hand-held power tool, and a second position extending along opposite sides of said housing with each section having portions thereof simulative of at least a portion of a full-scale engine whereby the body forms an engine for a toy, said handle being split along a midline thereof to form said sections, said simulative portions of said sections lying along registering surfaces of said sections when said sections lie in said first position.

14. A tool according to claim 13 wherein said indicia includes simulative valve cover or exhaust manifold.

15. A tool according to claim 13 wherein said tool holder is rotatable about an axis, said sections being pivotal between said first and second positions about discrete axes parallel to the rotatable axis of said tool holder.

16. A tool according to claim 13 in combination with a toy vehicle constructed of a plurality of parts joined to one another by fasteners, a tool carried by said tool holder, said fasteners and said tool having complementary surfaces whereby, upon engagement of said tool and said fasteners with said first section in said first position, said power tool is operable to fasten said parts to one another, said toy vehicle including wheels, a drive for said wheels, and a compartment for receiving said body with said first section in said second position thereof and said motor coupled to said wheel drive for driving the toy vehicle, a switch carried by said body for actuating said motor, first and second switch actuators carried by said body for actuating said switch, said first switch actuator being accessible by a user from said handle grip when said first section lies in said first position and said tool is used to fasten said parts to one another, said second switch actuator being accessible by a user when the first section lies in said second position and said toy engine simulative of a full-scale engine is disposed in said compartment.

* * * * *